US010690443B1

(12) United States Patent
Summers et al.

(10) Patent No.: US 10,690,443 B1
(45) Date of Patent: Jun. 23, 2020

(54) ROCKET MOTOR WITH COMBUSTION PRODUCT DEFLECTOR

(71) Applicant: Raytheon Company, Waltham, MA (US)

(72) Inventors: Matt H. Summers, Gilbert, AZ (US); James Kendall Villarreal, Tucson, AZ (US); David A. Smallwood, Oro Valley, AZ (US); Richard Dryer, Oro Valley, AZ (US); John M. Hitner, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/249,304

(22) Filed: Jan. 16, 2019

(51) Int. Cl.
*F41F 3/04* (2006.01)
*F42B 15/10* (2006.01)
*F41F 3/045* (2006.01)

(52) U.S. Cl.
CPC ..... *F41F 3/0413* (2013.01); *F41F 3/0455* (2013.01); *F42B 15/10* (2013.01)

(58) Field of Classification Search
CPC ..... F41F 3/0413; F41F 3/045; F41F 3/0455; F42B 15/10
See application file for complete search history.

(56) References Cited

U.S. PATENT DOCUMENTS 3,341,129 A * 9/1967 Adams, Jr. ..... F02K 9/80 239/265.11
3,421,410 A * 1/1969 Kayaian ..... F41A 19/59 89/1.807
3,841,562 A * 10/1974 Behnert ..... B64C 9/38 239/265.29
3,907,222 A * 9/1975 McComas ..... F02K 9/86 244/74
3,970,253 A * 7/1976 Burkes ..... F02K 9/86 239/265.19

(Continued)

FOREIGN PATENT DOCUMENTS

GB 1357976 A * 6/1974 ..... F41F 3/0413
RU 2041376 C1 * 8/1995

OTHER PUBLICATIONS

Javelin. <web.archive.org/web/20170809005527/http://www.military-today.com/missiles/javelin.htm 4/>. Aug. 9, 2017. (Year: 2017).*

*Primary Examiner* — Gabriel J. Klein
(74) *Attorney, Agent, or Firm* — Renner, Otto, Boisselle & Sklar, LLP

(57) ABSTRACT

A missile includes a rocket motor that has a flow deflector in an expansion region of the rocket motor's nozzle. The flow deflector diverts flow of combustion products away from a safe region that is aft of the missile. The safe region protects an operator of a launcher used to fire the missile, such as a shoulder-fired launcher, from harm caused by the combustion products. The flow deflector may be small enough such that it does not significantly adversely affect the performance of the rocket motor. The presence of the flow diverter may allow for the rocket motor to be started sooner in the flight of the missile, or at a distance closer to the operator, while still keeping the operator safe. The flow deflector and supporting structure, such as struts, may be additively manufactured with at least an aft part of the nozzle, as a continuous single-piece part.

19 Claims, 3 Drawing Sheets

(56) References Cited

U.S. PATENT DOCUMENTS

| | | | | | |
|---|---|---|---|---|---|
| 4,681,261 | A * | 7/1987 | Wetzler | F02K 9/97 | 239/265.11 |
| 5,422,443 | A * | 6/1995 | Piesik | B64F 1/26 | 137/896 |
| 2011/0101097 | A1 * | 5/2011 | Olden | F41F 3/045 | 235/404 |

* cited by examiner

ROCKET MOTOR WITH COMBUSTION PRODUCT DEFLECTOR

FIELD OF THE INVENTION

The invention is in the field of rocket motors, and missiles that include rocket motors.

DESCRIPTION OF THE RELATED ART

Shoulder-fired missiles that include rocket motors present a danger to the operator in that combustion gases from the rocket motor are directed back at the operator. The danger from these hot gases (and other combustion byproducts, such as debris) is often addressed by delaying firing of the rocket motor until the missile has flown a significant distance away from the operator. However this can have adverse system-level implications, such as a significantly large minimum range for the missile.

SUMMARY OF THE INVENTION

A missile includes a rocket motor having a flow deflector in its exhaust region, deflecting combustion products so as to create a safe region for the operator, behind the missile.

According to an aspect of the invention, a rocket motor includes: a fuel element; a converge-diverge nozzle through which combustion products from the burning of the fuel element pass; and a flow detector along a centerline of an expansion region of the nozzle. The flow deflector deflects away from the centerline combustion products from the burning of the fuel.

According to an embodiment of any paragraph(s) of this summary, the flow deflector is generally conical.

According to an embodiment of any paragraph(s) of this summary, the flow deflector has a maximum diameter.

According to an embodiment of any paragraph(s) of this summary, the flow deflector has a wedge shape.

According to an embodiment of any paragraph(s) of this summary, the flow deflector has a maximum extent of at least 3.2 mm (0.125 inches).

According to an embodiment of any paragraph(s) of this summary, the ratio of the maximum cross-sectional area of the flow deflector 52 to that of the exit port rocket motor 24 may be 1:16 to 1:64.

According to an embodiment of any paragraph(s) of this summary, the flow deflector is attached to an inner wall of a diverge portion of the nozzle, with the diverge portion defining the expansion region.

According to an embodiment of any paragraph(s) of this summary, the rocket motor further includes struts that attach the inner wall and the flow deflector together.

According to an embodiment of any paragraph(s) of this summary, the flow deflector, the struts, and at least part of the diverge portion are a single unitary additively-manufactured part.

According to an embodiment of any paragraph(s) of this summary, the rocket motor is part of a missile.

According to an embodiment of any paragraph(s) of this summary, the missile includes: a payload; and a booster that provides initial thrust to the missile, prior to operation of the rocket motor.

According to an embodiment of any paragraph(s) of this summary, the missile is in combination with a tubular launcher that launches the missile, wherein the launcher contains and directs force from the booster to provide thrust to the missile.

According to an embodiment of any paragraph(s) of this summary, the launcher is a shoulder-fired launcher.

According to another aspect of the invention, a method of firing a rocket-propelled missile includes the steps of: launching the missile from a launcher operated by an operator; and propelling the missile using a rocket motor of the missile. The propelling includes deflecting combustion products using a flow deflector in an expansion region of a nozzle of the rocket motor, thereby creating a safe region behind the missile, with the operator of the launcher is in the safe region.

According to an embodiment of any paragraph(s) of this summary, the launching includes the operator supporting the launcher on a shoulder of the operator.

According to an embodiment of any paragraph(s) of this summary, the creating the safe region includes creating a conical safe region, with the conical safe region having an axis coincident with a central axis of the expansion region.

According to an embodiment of any paragraph(s) of this summary, the creating the safe region includes creating a wedge-shape safe region.

According to an embodiment of any paragraph(s) of this summary, the creating the safe region includes creating a region having an extent of at least 30 cm perpendicular to a flight path of the missile at a distance of 6 meters behind the missile.

According to an embodiment of any paragraph(s) of this summary, the propelling is initiated with the missile at at least a 6 meters away from the launcher.

According to an embodiment of any paragraph(s) of this summary, the deflecting includes deflecting the combustion products using a bow shock produced by the deflector.

According to an embodiment of any paragraph(s) of this summary, the creating the safe region includes creating a region having a suitable extent perpendicular to a flight path of the missile at a suitable distance behind the missile.

According to an embodiment of any paragraph(s) of this summary, the propelling is initiated at the missile at at least a suitable time after the launching.

According to an embodiment of any paragraph(s) of this summary, the propelling is initiated with the missile at at least a suitable distance away from the launcher.

According to yet another aspect of the invention, a missile includes: a payload; a rocket motor for providing thrust to the missile during flight; and a booster for providing initial thrust to move the payload and the rocket motor out of a launcher. The rocket motor includes a flow deflector along a centerline of the rocket motor. The flow deflector deflects away from the centerline combustion products from the burning of fuel in the rocket motor.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A missile includes a rocket motor that has a flow deflector in an expansion region of the rocket motor's nozzle. The flow deflector diverts flow of combustion products away from a safe region that is aft of the missile. The safe region protects an operator of a launcher used to fire the missile, such as a shoulder-fired launcher, from harm caused by the combustion products. The flow deflector may be small enough such that it does not significantly adversely affect the performance of the rocket motor. The presence of the flow diverter may allow for the rocket motor to be started sooner in the flight of the missile, or at a distance closer to the operator, while still keeping the operator safe. The flow deflector and supporting structure, such as struts, may be additively manufactured with at least an aft part of the nozzle, as a continuous single-piece part.

Figure 1:
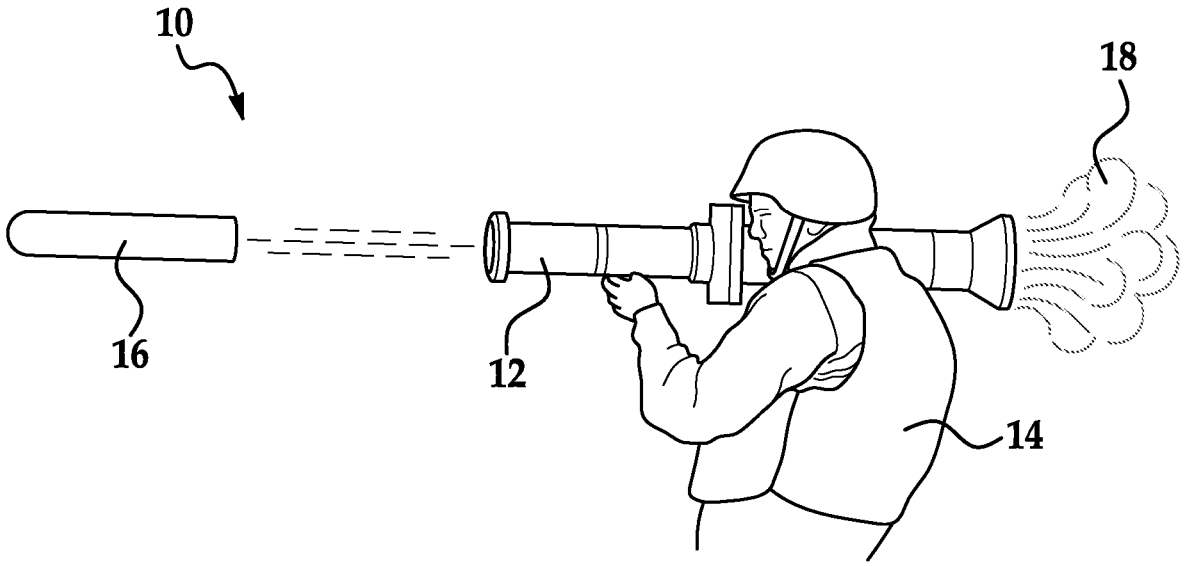
FIG. 1 is a schematic illustration of the firing of a missile according to an embodiment of the present invention.

FIG. 1 shows a weapons system 10 that includes a launcher 12 that is used by an operator 14 to launch a missile 16 toward a target (not shown), such as a building, vehicle, or aircraft, to give a few non-limiting examples. The launcher 12 is depicted as a shoulder-fired weapon, but may alternatively be supported by the operator 14 in other ways, such as being held by the operator 14 in another manner, and/or being supported next to the operator 14 by a tripod or other device.

The missile 16 is initially propelled from the launcher 12 by combustion or explosions within the launcher 12. This initial propulsion is produced by a boost charge (or booster), which may be a part of the missile 16. The products 18 produced by this initial boost exit out of the aft end of the launcher 12, the end of the launcher opposite from where the missile 16 is expelled. For a shoulder-fired weapon these combustion products (hot gasses, debris, and/or exhaust species) 18 do not represent a hazard to the operator 14 since they are directed behind and away from the operator 14.

The missile 16 includes a rocket motor to provide additional thrust during its flight. As described in greater detail below, the rocket motor includes a flow deflector that deflects some of the combustion products of the rocket motor (hot gasses, debris, and/or exhaust species) away from a region behind the missile, creating a safe region in which the operator 14 is located. The existence of this safe region allows ignition of the rocket motor more quickly in the flight of the missile 16, with the missile 16 closer to the launcher 12, relative to prior art approaches that require a missile to be further from the launch position before initiating a rocket motor, in order to avoid danger to the operator launching the missile.

Figure 2:
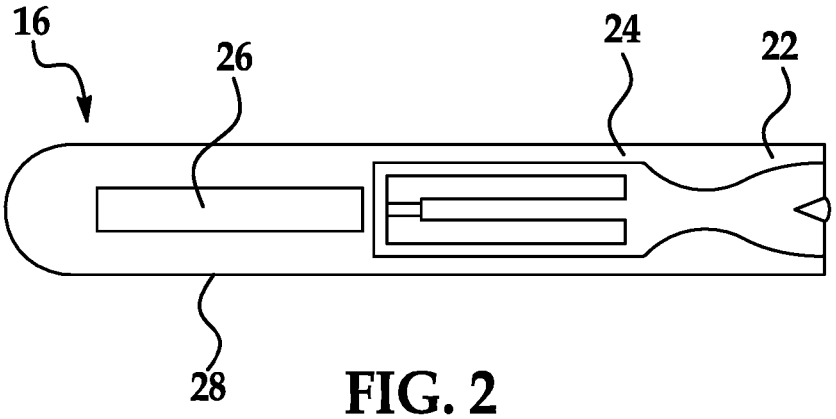
FIG. 2 is a schematic view of the missile of FIG. 1.

FIG. 2 shows some details regarding the missile 16. The missile 16 includes a booster (boost charge) 22 for providing the initial pulse in firing the missile 16 from the launcher 12 (FIG. 1), a rocket motor 24 for powering the missile 16 (providing thrust to the missile 16) while the missile 16 is in flight, and a payload 26. The booster 22 may be separate from the missile 16 or a part of the missile 16. The payload 26 may include any of a variety of devices for guiding the missile 16 to a target or intended destination, and/or for penetrating/damaging/defeating a target. For example the payload 26 may include high explosives, guidance systems, communication systems, proximity fuses and/or other initiators, an armor-piercing casing, and/or fragmentation or other lethality enhancement devices, to give a few non-limiting examples. A casing 28 may contain the parts of the missile 16 during flight.

Figure 3:
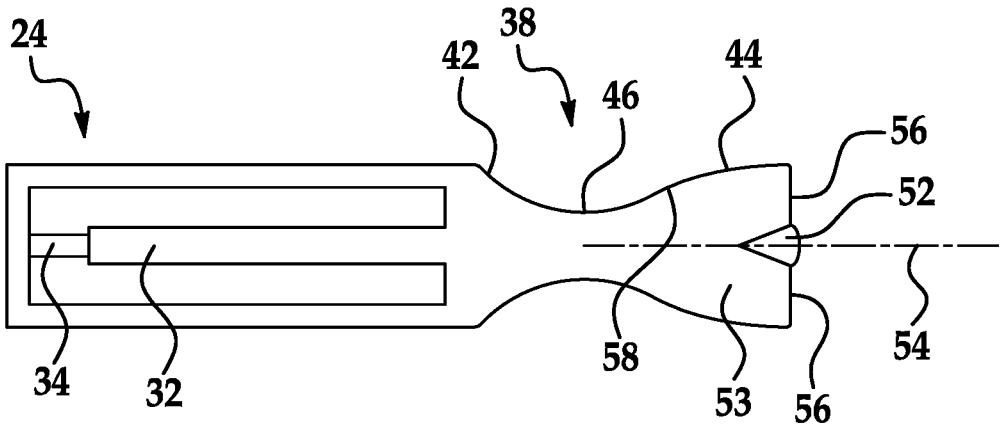
FIG. 3 is a cross-sectional view showing further details of the rocket motor of the missile of FIGS. 1 and 2.

FIG. 3 shows more detail regarding the rocket motor 24. The rocket motor 24 includes a fuel element 32 that is ignited by an igniter 34. The fuel element 32 may include any suitable fuel, for example a reduced-smoke double-based propellant or composite propellant. Combustion products from the burning of the fuel element 32 pass through a nozzle 38, which enhances the thrust produced from the combustion of the fuel. The nozzle 38 includes a converging compression portion 42, and a diverging expansion portion 44, with a throat 46 between the two portions 42 and 44.

A flow deflector 52 is located within an expansion region 53 defined by the diverging portion 44, along a centerline 54 of the expansion 44. The expansion region centerline 54 will generally correspond with (be coincident with) centerlines of the rocket motor 24 and of the missile 16 (FIG. 2), although other configurations are possible. For example it may be possible to place the flow deflector off of the centerline, above or below, and/or to the left or right of the centerline. Such placement off of the centerline 54 would result in a left/right and/or upward/downward thrust vector during initial flight of the missile 16. As another alternative, the deflector 52 may be canted at an angle to the centerline 54, which also would result a nonaxial thrust vector on the missile 16.

The flow deflector 52 is held in place by a series of struts 56 that link the flow deflector 52 to an inner wall 58 of the expansion portion 44. The struts 56 may be symmetrically spread in a circumferential direction around the centerline 54. There may be any suitable number of the struts 56, for example three or four of the struts 56. As an alternative to the struts 56, there may be a different support structure that supports the flow deflector 52.

The flow deflector 52 and the struts 56 may be made as a single part with all or a part of the nozzle 38. The single part may be made, for example, using additive manufacturing techniques, although non-additive techniques may be used instead. Any suitable material may be used for the flow deflector 52, for example a metal or ceramic capable of withstanding high temperatures.

Figure 4:
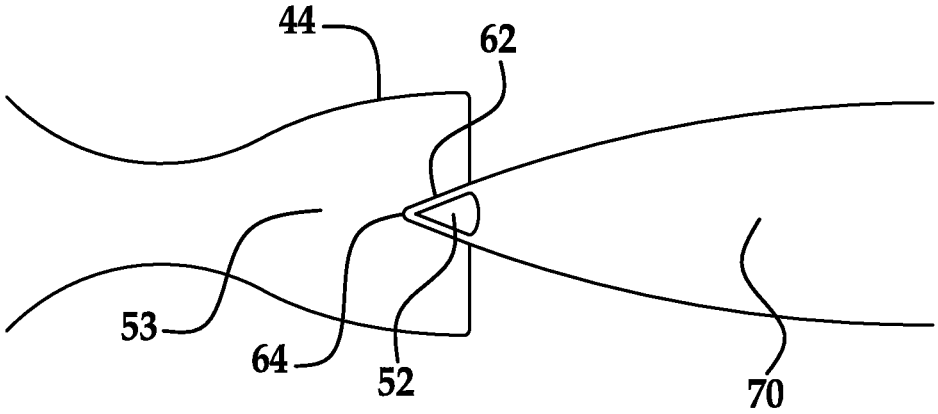
FIG. 4 is a side view illustrating operation of the rocket motor of FIG. 3.

The flow deflector 52 is generally conical, with a rounded point (nearing blunt/flat), as opposed to a sharp point, in the illustrated embodiment. The narrow portion of the cone faces forward, toward the front of the missile 16 (FIG. 1). As illustrated in FIG. 4, the flow deflector 52 generates a bow shock 62 at a stagnation point 64 forward of the flow deflector 52.

Figure 5:
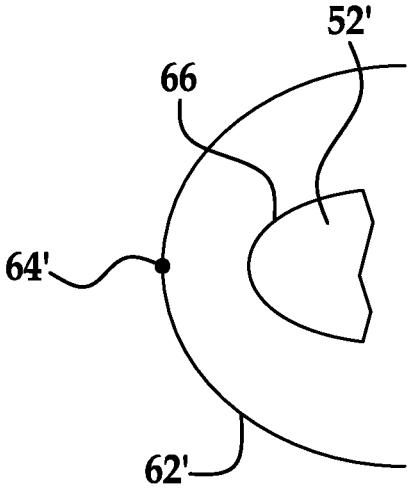
FIG. 5 is a side view illustrating the front end of one embodiment of the flow deflector of FIG. 4.

FIG. 5 shows one possible configuration of the flow deflector 52, with a blunt rounded nose 66 of a flow deflector 52' generating a bow shock 62' with a stagnation point 64'.

Figure 6:
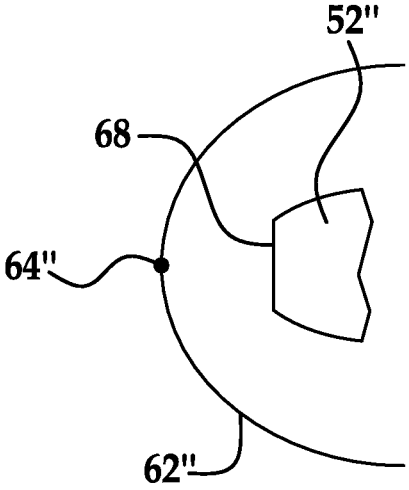
FIG. 6 is a side view illustrating the front end of another embodiment of the flow deflector of FIG. 4.

FIG. 6 shows another possible configuration, with a flat nose 68 of a flow deflector 52" generating a bow shock 62" with a stagnation point 64".

With reference again to FIG. 4, The deflection of the flow creates a conical safe region 70 behind the rocket motor 24 and the missile 16. In the safe region 70 the combustion products have been sufficiently shifted away from the centerline 54 such that the temperature, composition, and pressure in the region is not a hazard to the operator 14 (FIG. 1). Suitable standards for hazards to humans may be used to determine when a region is safe for humans.

The safe region 70 may have a radius near the flow deflector 52 that is about the radius of the wide end of the flow detector 52, or of the region inside the bow shock 62 at the Downstream of the flow detector 52 the safe region 70 may have an angle of expansion of suitable extent, for example having an angle of about 2 degrees. The flow deflector 52 may have a diameter of 3.2 mm (0.125 inches) to 6.4 mm (0.25 inches), although other sizes are possible. The ratio of the maximum cross-sectional area of the flow deflector 52 to that of the exit port rocket motor 24 may be 1:16 to 1:64, although again other ratios are possible.

The safe region 70 may be significantly wide at a reasonable distance downstream of the missile 70 to protect the operator 14. This may be the case even when the flow deflector 52 has a small diameter and thus a small effect on the performance of the rocket motor 24. To give one non-limiting example, the flow deflector 52 may have a diameter suitable to produce the safe region 70 with a suitable diameter at a suitable distance downstream from the aft end of the rocket motor 24. For example the safe region 70 may have a diameter of 30.5 cm (12 inches) at a distance of 6 meters (20 feet) from the missile 16. This may allow firing of the rocket motor 24 at such a distance away from the operator, while giving protection to exposed/vulnerable body parts of the operator firing a shoulder-fired missile. For example the head/face of the operator may be within the safe region 70. This may allow less hazard to the operator, and/or may reduce the requirement for protective plates or other structures of the launcher, which would otherwise be used to protect the operator.

More broadly, the use of the flow deflector 52 may allow firing of the rocket motor at a distance of 6 meters (20 feet) to 15 meters (50 feet) into flight of the missile 16. This contrasts with missiles without a flow deflector, which may require 30 meters (100 feet) of flight distance before firing of a rocket motor.

The placement of the flow deflector 52 on the centerline 54 means that the exhaust plume is diverted in an axisymmetric manner. This advantageously does not impart any nonaxial thrust vector into the rocket motor 24 of the missile 16. However, as noted above, other configurations are possible that put a nonaxial thrust vector onto the missile 16, which may be desirable in some situations.

The use of flow deflector 52 reduces to some extent the undesirable effects of the combustion products on the operator 14 (FIG. 1), in the region immediately behind the missile 16. This may allow for ignition of the rocket motor 24 at relatively close distance away from the mouth of the launcher 12, closer than would be safe in the absence of the flow diverter 52. For example the rocket motor 24 may be ignited at a suitable distance away from the operator 14, and/or at a suitable time into flight.

Figure 7:
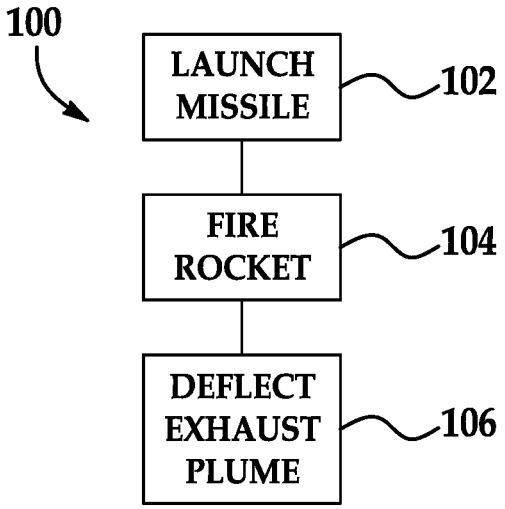
FIG. 7 is a high-level flow chart of a method according to an embodiment of the invention.

FIG. 7 shows a method 100 for firing a rocket-propelled missile, such as the missile 16 (FIG. 1). In step 102 the missile 16 is launched from a launcher, such as the shoulder-fired launcher 12 (FIG. 1). In step 104 the rocket motor 24 (FIG. 2) is fired, and in step 106 (occurring at the same time as step 104) the flow deflector (FIG. 3) deflects the exhaust plume of the rocket motor 24 so as to create the safe region 70 (FIG. 4), protecting the operator 14 (FIG. 1) from the hot combustion products.

Figure 8:
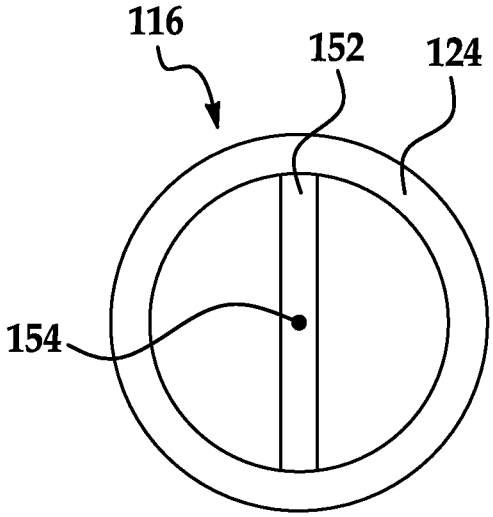
FIG. 8 is a back view of a missile with an alternate embodiment deflector.
Figure 9:
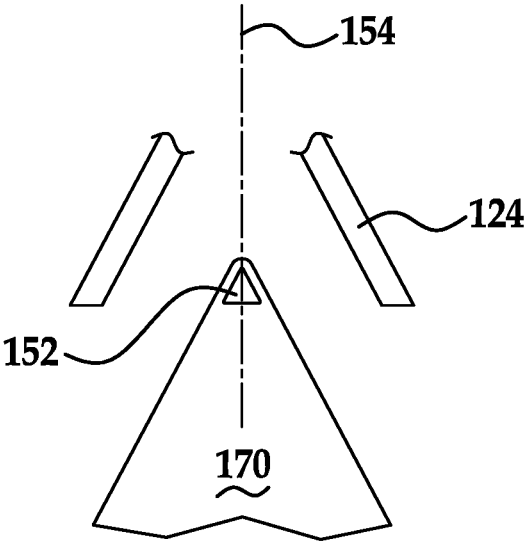
FIG. 9 is a top sectional view of part of the missile of FIG. 8.

FIGS. 8 and 9 show an alternative configuration, a flow deflector 152 that has a wedge shape, with a narrower end pointed upstream into an exhaust flow from a rocket motor 124 of a missile 116. The flow deflector 152 may extend straight across a diameter of the rocket motor 124, passing through a centerline 154 of the rocket motor 124. The cross-sectional shape of the flow deflector 152 may be constant along its length from one end to the opposite end, although a non-constant cross-sectional shape is an alternative. The flow deflector 152 creates a wedge-shape safe region 170 downstream of the flow deflector 152.

The flow deflector 152 may have comparable dimensions, features, and/or variations to those described above for the flow deflector 52. For example the maximum width of the flow deflector 152 may be similar to diameter of the flow deflector 52, the extend of the safe region 170 may be similar to that of the safe region 70, the material of the two flow deflectors 52 and 152 may be the same, and/or the leading edge of the flow deflector 152 may be rounded or flat.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A rocket motor comprising:

a fuel element;

a converge-diverge nozzle through which combustion products from the burning of the fuel element pass; and a flow deflector along a centerline of an expansion region of the nozzle;

wherein the flow deflector deflects away from the centerline combustion products from the burning of the fuel;

wherein the flow deflector is attached to an inner wall of a diverge portion of the nozzle via struts, with the diverge portion defining the expansion region; and wherein an upstream end of the flow deflector is in the diverge portion of the nozzle.

2. The rocket motor of claim 1, wherein the flow deflector is conical.

3. The rocket motor of claim 1, wherein the flow deflector has a wedge shape.

4. The rocket motor of claim 1, wherein the flow deflector has a maximum extent of at least 3.2 mm (0.125 inches).

5. The rocket motor of claim 1, wherein the flow deflector, the struts, and at least part of the diverge portion are a single unitary additively-manufactured part.

6. The rocket motor of claim 1, as part of a missile, wherein the missile also includes:

a payload; and a booster that provides initial thrust to the missile, prior to operation of the rocket motor.

7. The missile of claim 6, in combination with a tubular launcher that launches the missile, wherein the launcher contains and directs force from the booster to provide thrust to the missile.

8. The combination of claim 7, wherein the launcher is a shoulder-fired launcher.

9. The rocket motor of claim 1, wherein the upstream end of the flow deflector is a rounded nose.

10. The rocket motor of claim 1, wherein the upstream end of the flow deflector is a flat nose.

11. The rocket motor of claim 1, wherein the flow deflector is at a downstream end of the diverge portion of the nozzle.

12. The rocket motor of claim 1, wherein the flow deflector extends straight across a diameter of the rocket motor.

13. A method of firing a rocket-propelled missile, the method comprising:

launching the missile from a launcher operated by an operator; and propelling the missile using a rocket motor of the missile;

wherein the propelling includes deflecting combustion products using a flow deflector in an expansion region of a nozzle of the rocket motor, wherein an upstream end of the flow deflector is in a diverge portion of the nozzle, thereby creating a safe region behind the missile, when the operator of the launcher is in the safe region.

14. The method of claim 13, wherein the launching includes the operator supporting the launcher on a shoulder of the operator.

15. The method of claim 13, wherein the creating the safe region includes creating a conical safe region, with the conical safe region having an axis coincident with a central axis of the expansion region.

16. The method of claim 13, wherein the creating the safe region includes creating a wedge-shape safe region.

17. The method of claim 13, wherein the deflecting includes deflecting the combustion products using a bow shock produced by the deflector.

18. The method of claim 13, wherein the creating the safe region includes creating a region having an extent of at least 30 cm perpendicular to a flight path of the missile at a distance of 6 meters behind the missile.

19. The method of claim 13, wherein the propelling is initiated with the missile at least a 6 meters away from the launcher.

* * * * *